United States Patent [19]

Miyamoto

[11] 4,384,712

[45] May 24, 1983

[54] SHEET MEMBER CONVEYING DEVICE

[75] Inventor: Koichi Miyamoto, Tokyo, Japan

[73] Assignee: Canon Kabushiki Kaisha, Tokyo, Japan

[21] Appl. No.: 190,410

[22] Filed: Sep. 24, 1980

[30] Foreign Application Priority Data

Oct. 4, 1979 [JP] Japan ..... 54-127322

[51] Int. Cl.[3] ..... B65H 7/08

[52] U.S. Cl. ..... 271/261; 271/263; 271/273

[58] Field of Search ..... 271/258, 259, 261, 263, 271/273, 274

[56] References Cited

U.S. PATENT DOCUMENTS 3,661,383 5/1972 Morrison ..... 271/273
3,737,159 6/1973 Washio ..... 271/263
3,819,266 6/1974 Price ..... 271/263 X
4,231,567 11/1980 Ziehm ..... 271/259

*Primary Examiner*—Richard A. Schacher
*Attorney, Agent, or Firm*—Fitzpatrick, Cella, Harper & Scinto

[57] ABSTRACT

A sheet member conveying device has a reception port for receiving a sheet member from a previous step, a discharge port for feeding the sheet member to the next step, first conveying means provided near the reception port, second conveying means provided near the discharge port, and sheet member abnormal conveyance detecting means provided near the discharge port to stop the second conveying means when abnormal conveyance of the sheet member has been detected and to continue the operation of the first conveying means for a predetermined time thereafter.

3 Claims, 3 Drawing Figures

SHEET MEMBER CONVEYING DEVICE

BACKGROUND OF THE INVENTION

1. Field of the Invention

This invention relates to a sheet member conveying device in a copying machine, a printer or the like.

2. Description of the Prior Art

A copying machine, a printer or the like is provided with a conveying device for conveying sheet members from a paper supply station to an image forming station or from the image forming station to a discharge port. This conveying device is variously designed to reduce jam, but it is impossible to eliminate jam completely. Thus, when jam has occurred, the jammed sheet member must be removed from the conveyance path, and how to make such jamming sheet member easy to remove is one task imposed on the sheet member conveying device. Usually, jam occurs at an intricate portion of the machine and it is difficult to remove a sheet member jammed at such portion and therefore, it has also been proposed that a sheet member obliquely moving which may jam be checked before it arrives at such portion and be stopped at a place where it is easier to remove the sheet member. Even in such case, the stopped paper must be removed by the operator.

The removal of the jammed paper or the paper stopped at the place where the removal is easier is carried out by withdrawing the sheet member conveying device out of the machine to provide a wide space which makes the removing work easier. In this case, the direction in which the sheet member conveying device is withdrawn out of the machine should preferably be the front side direction of the machine body. This is because, at the front side of the machine body, there is usually secured a space for the operator to carry out the copying or printing work and in contrast, it is often the case that the lateral or back side of the machine body is urged against a wall or the like to very much limit the working space.

Now, it is often the case that the direction of sheet member conveyance in the sheet member conveying device is orthogonal to the direction in which the sheet member conveying device is withdrawn toward the front side of the machine body. During said withdrawal, it is impractical to withdraw the entire sheet member conveyance path of the machine and therefore, it is the common practice to divide the sheet member conveyance path into several units and construct a unit-like sheet member conveying device so that any one of the units can be withdrawn as required.

Heretofore, when abnormal conveyance such as jam or oblique movement has been detected, the sheet member conveyance has been stopped on the spot to prevent any further spread of damage. When this is done, a sheet member sometimes stops astride adjacent two units. If both two units are withdrawn simultaneously at this time, there would be no problem, but if only one of the two units is withdrawn, since the direction of withdrawal is orthogonal to the direction of sheet member conveyance, the sheet member would be torn off and pieces of the sheet member would be scattered resulting in great inconvenience. The stopped condition of the sheet member is difficult to observe from outside of the machine and it is not known until the unit is withdrawn, and therefore the occurrence of such inconvenience is difficult to prevent.

Also, there are cases where jam or the like having occurred during continuous operation of the machine is followed by the start of conveyance of the next sheet member. If the entire machine is stopped at such time, the succeeding sheet member would stop in the conveyance path and, if such sheet member is left as it is, the portion of the sheet member which is urged against the conveyor roller would inveterately be curled. Therefore, if the machine is restarted without such sheet member being removed from the conveyance path, the sheet member would catch a guide or the like due to the curling habit thereof, thus causing a new jam. Accordingly, if the preceding sheet member has jammed, it is preferable to remove that preceding sheet member and also remove all the sheet members in the sheet member conveyance path. However, it is often the case with the operator that he pays attention only to the jammed sheet member and forgets the existence of the succeeding sheet members in the other conveyance units and fails to remove such succeeding sheet members.

SUMMARY OF THE INVENTION

It is therefore an object of the present invention to provide a sheet member conveying device which, when abnormal conveyance such as a jam or oblique movement has occurred, prevents a sheet member from being stopped astride two units and also prevents removal of the succeeding sheet members from being forgotten.

To achieve the above object, the present invention is constructed so that when abnormal conveyance of a sheet member has been detected by detecting means provided near a sheet member discharge port, conveyor means near the discharge port is stopped on the spot while conveyor means near a sheet member reception port is permitted to continue to operate for a predetermined time.

With such construction of the present invention, a sheet member is never stopped astride two unit sheet member conveying devices. Accordingly, the sheet member can be readily removed. Also, it cannot happen that one forgets to remove the succeeding sheet members continuously fed and thus, the present invention is very useful as a sheet member conveying device.

The invention will become more fully apparent from the following detailed description thereof taken in conjunction with the accompanying drawings.

DESCRIPTION OF THE PREFERRED EMBODIMENTS

Figure 1:
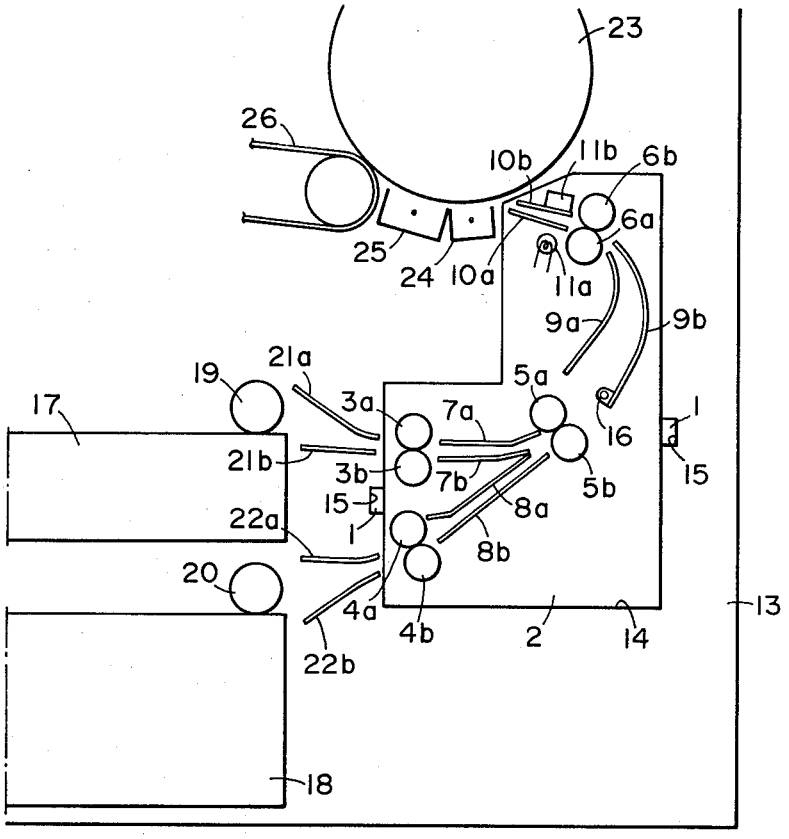
FIG. 1 is a front view of the device of the present invention applied to a copying machine.

The present invention will hereinafter be described with respect to an embodiment shown in the drawings. FIG. 1 is a front view of the sheet member conveying device of the present invention applied between the paper supply station and the transfer station of a copying machine, and FIG. 2 is a perspective view of the sheet member conveying device as withdrawn from the copying machine.

The shown unit-like sheet member conveying device comprises pairs of paper feed rollers 3*a*, 3*b*; 4*a*, 4*b*; 5*a*, 5*b*; 6*a*, 6*b* rotatably supported between bearing plates 2 and 2 connected by connecting members 1 and 1 serving also as rails, pairs of guide plates 7a, 7b; 8a, 8b; 9a, 9b; 10a, 10b disposed between the respective pairs of rollers and on the discharge side of the pair of rollers 6a, 6b, and two sets of jam and oblique movement detecting means comprising lamps 11a, 12a and light-receiving elements 11b, 12b disposed on the opposite sides of the guide plates 10a, 10b lengthwisely thereof (widthwisely of sheet member).

This unit-like sheet member conveying device is withdrawably mounted in the opening 14 of a copying machine 13 with the rails 1 and 1 fitted in the recesses 15 formed in the edges of the opening.

Figure 2:
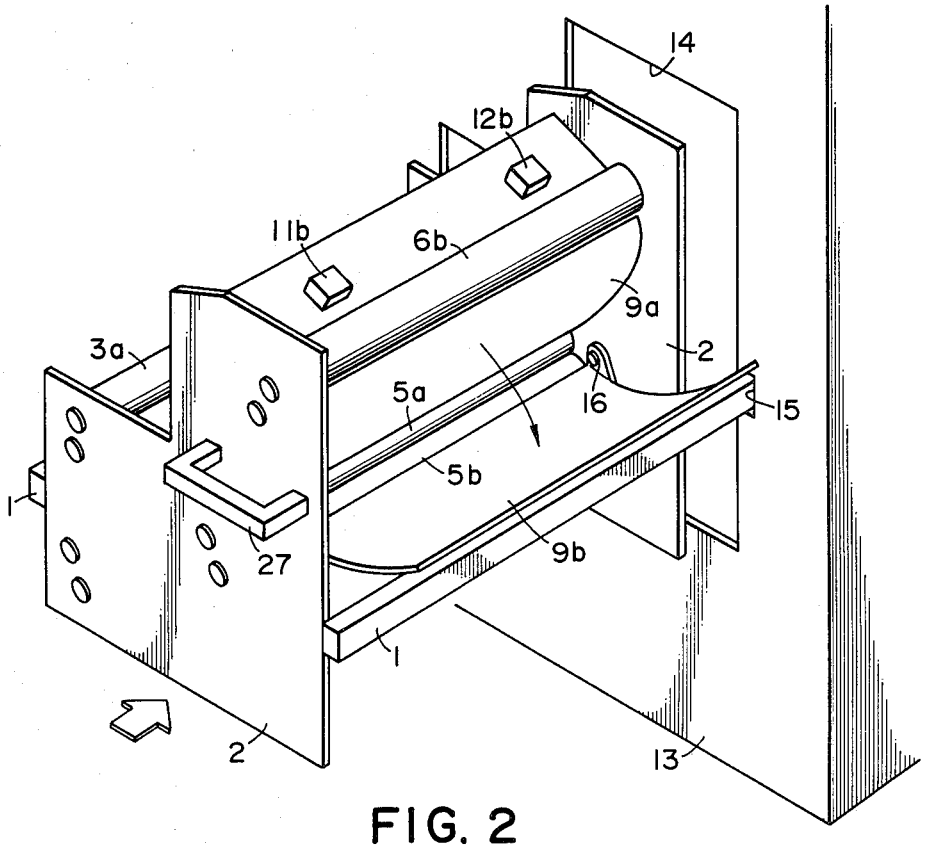
FIG. 2 is a perspective view of the device as withdrawn from the copying machine.

One, 9b, of the pair of guide plates 9a, 9b is normally biased toward the other guide plate 9a by a spring, not shown, to form a paper feed path, and it is designed such that when a jamming sheet member is to be removed, it can be opened in the direction of arrow about a mounting shaft 16 as shown in FIG. 2.

A sheet member fed from a cassette 17 or a paper supply deck 18 by a feed roller 19 or 20 passes between a pair of guide plates 21a and 21b or a pair of guide plates 22a and 22b and is fed between the pair of rollers 3a and 3b or 4a and 4b of the unit-like sheet member conveying device. The sheet member fed from the unit-like sheet member conveying device is brought into intimate contact with a photosensitive drum so that the image on the photosensitive drum 23 is transferred to the sheet member with the aid of a transfer charger 24. Then, the sheet member is separated from the photosensitive drum 23 by a separating charger 25 and is transported to a fixing station, not shown, by a conveyor belt 26.

During the above-described conveyance of the sheet member, if the jam and oblique movement detecting means 11a, 11b; 12a, 12b does not detect a sheet member within a predetermined time, said detecting means produce a timing jam signal, judging that a sheet member has jammed somewhere within the unit conveying device. Also, if the detecting means continue to detect a sheet member for a longer time than the predetermined time, the detecting means produces a stagnant jam signal, judging that jam has occurred in the guide plates 10a, 10b. Further, if the time difference when the two sets of detecting means 11a, 11b; 12a, 12b have detected the leading end of the same sheet member exceeds a predetermined time, the detecting means judges that a sheet member is being moved obliquely, thus producing an oblique movement signal to prevent occurrence of jam in the subsequent path.

Figure 3:
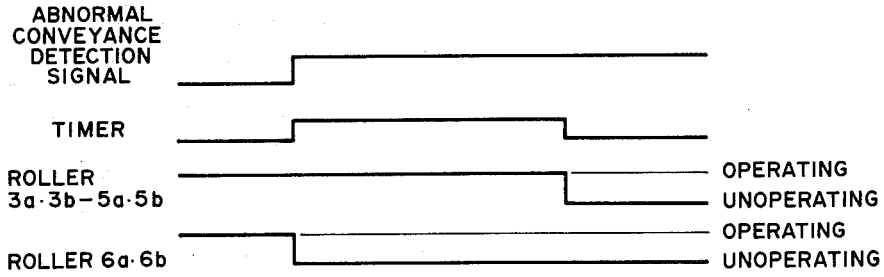
FIG. 3 is a timing chart.

An electric circuit (not shown) is constructed so that when any of the above-mentioned detection signals is put out from the detecting means 11a, 11b; 12a, 12b, the pair of rollers 6a, 6b are immediately stopped but the other pairs of rollers 3a, 3b; 5a, 5b continue to operate for a predetermined time determined by a timer (not shown) operated upon reception of said detection signal. With such construction, when, for example, oblique movement of a sheet member has been detected, the movement of the leading end portion of the sheet member is restrained by the stoppage of the pair of rollers 6a, 6b, but the trailing end portion of the sheet member is fed into between the pair of guide plates 9a, 9b by the continued rotation of the pairs of rollers 3a, 3b–5a, 5b. Accordingly, the predetermined time of the timer is set to a sufficient time for the largest sheet member used to completely pass between the pair of rollers 5a and 5b. The operation timing relations between the above-described various portions are shown in FIG. 3.

When the operation of all pairs of rollers has been stopped, if the unit-like sheet member conveying device is withdrawn from the copying machine 13 as shown in FIG. 2 by gripping a handle 27 provided on the outer surface of the bearing plate 1 and the guide plate 9b is opened, a sheet fed into between the pair of guide plates 9a and 9b can be readily removed. Also, even when a preceding sheet member jams and a succeeding sheet member already lies in the conveyance path, it is only the pair of rollers 6a, 6b that is stopped when a detection signal has been put out from the detecting means and the other pairs of rollers 3a, 3b–5a, 5b, continue to rotate and therefore, the succeeding sheet member is also fed into between the guide plates 9a and 9b. Accordingly, both the preceding jamming sheet member and the succeeding sheet member gather at the same place and can be readily removed.

What I claim is:

1. In a machine for handling sheet material, a sheet conveying unit mounted to enable withdrawal from said machine, said unit comprising:

means comprising sheet guiding members defining a sheet conveyance path from an inlet of said unit to an outlet thereof, at least one of said sheet guiding members being movable in a direction away from the other;

inlet side conveying means for receiving a sheet from the inlet and conveying it along said conveyance path;

outlet side conveying means for receiving the sheet from said inlet side conveyance means and conveying it to the outlet;

means, located adjacent to said outlet side conveying means, for detecting abnormal conveyance of the sheet, and stopping, when abnormal conveyance is detected, said outlet side conveying means and maintaining operation of said inlet side conveying means for a predetermined time period after the stopping of said outlet side conveying means; and guide means supporting said conveying unit for linear movement in a direction substantially perpendicular to the sheet conveyance path to permit withdrawal of said unit relative to said machine.

2. A machine according to claim 1, wherein said machine is a copying machine, wherein said inlet conveying means is located adjacent a sheet stack station of the copying machine, and said outlet side conveying means is adapted to be located adjacent copy forming apparatus of the machine.

3. A sheet conveying device usable with a sheet handling machine such as a copying machine or the like, comprising:

a sheet conveying unit, detachable from the sheet handling machine, having a sheet inlet, inlet side conveying means for receiving a sheet from the inlet, a sheet outlet, outlet side conveying means for receiving the sheet from said inlet side conveying means and conveying it to the outlet, and sheet guiding members, between said inlet side conveying means and said outlet side conveying means, for defining a sheet conveying path therebetween, at least one of said sheet guiding members being movable in a direction away from the other;

unit guiding means for guiding said sheet conveying unit in the direction substantially perpendicular to the conveyance path;

a detector for detecting abnormal sheet conveyance; and control means for stopping operation of said outlet side conveying means while allowing continuation of operation of said inlet side conveying means for a predetermined period, when said detecting means detects abnormal sheet conveyance.

* * * * *